United States Patent [19]

Katz

[11] Patent Number: 4,794,858

[45] Date of Patent: Jan. 3, 1989

[54] PNEUMATIC RELEASE MANDREL

[76] Inventor: Sidney Katz, 6 Hedgerow La., Spring Valley, N.Y. 10977

[21] Appl. No.: 110,223

[22] Filed: Oct. 19, 1987

[51] Int. Cl.[4] ..... B41F 13/10; B41F 13/20

[52] U.S. Cl. ..... 101/375; 29/113.1

[58] Field of Search ..... 101/375; 29/113 R; 51/373; 242/72 B; 279/2 A

[56] References Cited

U.S. PATENT DOCUMENTS

| | | | |
|---|---|---|---|
| 3,972,488 | 8/1976 | Lee et al. | 242/72 B |
| 4,089,265 | 5/1978 | White et al. | 101/375 |
| 4,381,709 | 5/1983 | Katz | 101/375 |
| 4,383,483 | 5/1983 | Moss | 101/375 |
| 4,386,566 | 6/1983 | Moss | 101/375 |
| 4,407,199 | 10/1983 | Moss | 101/375 |
| 4,651,643 | 3/1987 | Katz et al. | 101/375 |

*Primary Examiner*—Clifford D. Crowder

*Attorney, Agent, or Firm*—Abelman Frayne Rezac & Schwab

[57] ABSTRACT

A mandrel for the support of a printing cylinder includes a hollow cylindrical shell, the axial ends of which are enclosed by trunnions and expansion heads. Compressed air is admitted into the shell through one of the trunnions and escapes through apertures in the hollow shell and into the interior of a printing cylinder, and, is employed to expand a resilient sheath positioned on the printing cylinder.

4 Claims, 1 Drawing Sheet

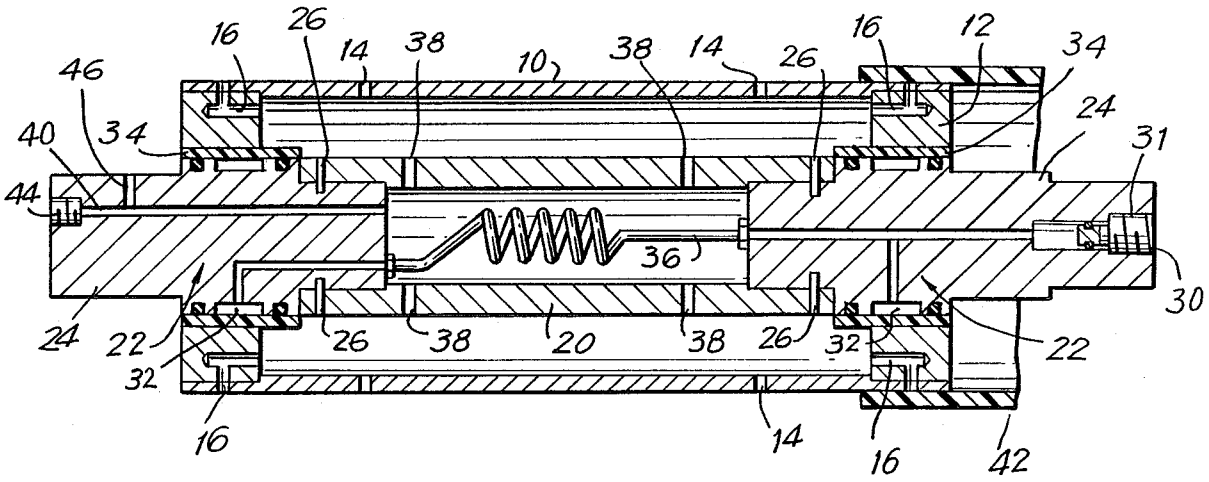
30
31
34
24
22
42
12
16
16
26
32
26
14
14
38
36
38
10
20
38
38
14
26
26
16
16
34
22
32
46
24
40
44

PNEUMATIC RELEASE MANDREL

FIELD OF THE INVENTION

This invention relates to mandrels used in the support, centering and rotation of printing cylinders.

BACKGROUND OF THE INVENTION

Mandrels are known from U.S. Pat. No. 4,381,709, issued May 3, 1983, which incorporate hydraulically actuable expansion heads, whereby a printing cylinder can be passed over the expansion heads and then locked in position on the mandrel by actuating one or more hydraulic actuators to cause the expansion heads to expand radially outwardly into locking frictional engagement with the interior surface of the printing cylinder.

The printing cylinders are of larger internal diameter than the external diameter of the mandrel itself, and only slightly larger than the external diameter of the expandable heads. Thus, a dead air space is provided between the mandrel proper and the printing cylinder.

The printing cylinder is employed to support printing plates which are secured directly to the outer surface of the printing cylinder. Thus, a costly printing cylinder must be employed in each printing run, the only option being or removing that cylinder and the attached printing plates and substituting another equally costly cylinder having different printing plates attached thereto.

The printing cylinders themselves are costly in that accurate machining thereof is required in order to ensure axial linearity and radial concentrically of the printing cylinders relative to their supporting mandrel.

The consequence of this known technology is that a very considerable number of costly printing cylinders must be kept in inventory, with the consequent expense of warehousing those cylinders.

More recent developments in the printing industry have provided a partial solution to the problem by providing a tubular cylindrical sheath of a resilient plastics material which is a force fit over the printing cylinder, and to which the required assemblage of printing plates is attached.

The sheath is removable from the printing cylinder, or in the alternative positionable thereon, by expanding the sheath radially outwardly under the action of compressed air fed into the printing cylinder and which escapes through radial perforations in the axial wall of the printing cylinder. In this manner, a cushion of pressurized air is provided within the sheath which acts to expand the sheath radially outwardly to break its frictional contact with the outer surface of the printing cylinder, this in turn permitting the sheath to be slid onto the printing cylinder or removed therefrom in an axial direction.

While this technique still requires warehousing of the sheaths themselves and the attached printing plates, the cost of providing a corresponding number of costly printing cylinders is eliminated in that a single printing cylinder can be employed in combination with any one of a number of relatively inexpensive sheaths.

While the savings are substantial, the technique carries with it the need to provide a relatively costly and cumbersome compressed air jig that provides for the closure of the respective ends of the printing cylinder, and in turn permits pressurization of the interior thereof.

Further, this technique carries with it the disadvantage that the printing cylinder itself must be removed from the mandrel in order for it to be inserted in the compressed air jig, and, subsequent to replacement of the sheath, it must then be repositioned and locked onto the mandrel, this increasing down time and manual labor in the removal and exchange of the sheaths.

SUMMARY OF THE INVENTION

According to the present invention, the need to provide a compressed air jig is eliminated in its entirety, as is the need to remove the printing cylinder from the mandrel and subsequently repositioning the printing cylinder on the mandrel.

This is accomplished by providing a mandrel which itself is capable of functioning as a compressed air jig, it only being necessary to attach a compressed air supply hose to the mandrel in order to permit the positioning of a sheath on the printing cylinder or its removal therefrom.

This is accomplished according to the present invention by forming the mandrel itself as a hollow cylindrical shell which is closed at each of its ends by a trunnion and an expansion head assembly, and which provides a closed cavity into which compressed air can be admitted through a compressed air port in one of the trunnions. Compressed air is permitted to escape from the closed cavity through radial openings in the cylindrical shell. The escaping pressurized air then passes into the dead air space between the exterior of the hollow cylindrical shell and the interior wall of the printing cylinder, and is then operative to expand a sheath positioned on the printing cylinder exterior during its removal from the printing cylinder or its positioning on the printing cylinder, and this without requiring removal of the printing cylinder from the mandrel and its subsequent repositioning on the mandrel.

DESCRIPTION OF THE DRAWINGS

A preferred embodiment of the invention will now be described with reference to the single FIGURE of the accompanying drawings, which represents an axial cross-section through a mandrel according to the present invention.

DESCRIPTION OF THE PREFERRED EMBODIMENT

Referring now to the drawing, a printing cylinder is shown at 10, the printing cylinder having an annular reinforcing ring 12 at its respective axial ends, the printing cylinder and the annular reinforcing rings being rigidly attached to each other in any convenient manner, such as by welding, adhesive bonding, brazing, riveting or the like. The printing cylinder 10 is provided with multiple radially extending ports 14 positioned axially thereof. Additionally, the annular reinforcing rings 12 are provided with ports 16 communicating with ports closely adjacent the ends of the printing cylinder.

The printing cylinder is positioned on a mandrel 20 having expansion heads 22 at its opposite axial ends, the expansion heads being supported by trunnions 24 which extend into the mandrel 20 to provide support from the mandrel 20. The mandrel 20 and the trunnions 24 are secured to each other in any convenient manner, such, for example, as by means of radial pins or screws 26.

In the illustrated embodiment, one of the trunnions 24 is provided with a hydraulic pump 28 of any conventional type, such as one incorporating a threaded actuating screw and piston 30 which can be screwed into or out of a threaded bore 31 in the trunnion. On actuation of the hydraulic pump 28, hydaulic fluid under pressure is fed to galleries 32 in the respective trunnions and acts on radially expandable diaphragms 34 providing closures for the galleries 32 in order to expand the diaphragms 34 into frictional locking engagement with the annular reinforcing rings 12.

In the illustrated embodiment, the respective galleries and the hydraulic pump are interconnected with each other by means of a conduit 36 formed from a suitable metal tubing which has been formed into a compression spring. This construction allows connection between one trunnion 24 and one end of conduit 36. Trunnion 24 then is assembled into bore of 20. The other end of conduit 36 now projects sufficiently out other end of bore to permit the other trunnion 24 to be connected to conduit 36. The final assembly is possible because 36 can compress. By making the spring portion of conduit 36 of an outside diameter slightly smaller than the I.D. of 20, stresses at the connections to trunnions 24 due to centrifugal forces during press rotation are minimized. In an alternative embodiment, a hydraulic pump can be provided in each of the trunnions, in which event the interconnecting conduit 36 can be omitted.

As will be readily apparent from the drawing, the mandrel 20 is in the form of a hollow cylindrical shell which is provided with ports 38 communicating the interior of the hollow shell with the dead air space internally of the printing cylinder 10. The other of the trunnions 24 is provided with a passage 40 for the supply of compressed air from a conventional compressed air supply hose [not shown] into the interior of the hollow shell of the mandrel 20.

Conveniently, the compressed air supply passage 40 extends axially through the associated trunnion, thus permitting access to the interior of the hollow cylindrical shell in an axial direction. Alternatively, the passage 40 can be closed by a plug 44, and, the passage 40 be provided with a lateral branch passage 46 providing a connector for the compressed air supply hose. In this manner, either one of the passages can be employed at the convenience of the operator to provide a connection either in the axial direction of the mandrel, or in a direction radial thereto.

The drawing illustrates a sheath of plastics material in the process of being positioned over the printing cylinder 10 by moving it axially along the cylinder 10. As is known in the technology, the sheath 42 is formed as a hollow cylinder of resilient plastics material which is capable of expansion in the radial direction. Thus, compressed air supplied by the port 16 of the associated annular reinforcing ring 12 at that end of the printing cylinder will be supplying a cushioning flow of air to the juxtaposed faces of the sheath 42 and the printing cylinder 10 in order to expand the sheath 42 radially outwardly to a slightly larger diameter than the diameter of the printing cylinder 10, thus permitting the sheath 42 to slide axially of the printing cylinder 10 with the cushioning layer of air acting as a parting agent eliminating frictional restraint on the movement of the sheath 42.

As the sheath 42 proceeds further to the left in the drawing, it will then encounter the outlet ports 14, and ultimately will reach a position in which it is completely positioned over the printing cylinder 10, at which time the supply of compressed air to the interior of the mandrel is discontinued, this in turn permitting the sheath 42 to shrink onto the external surface of the printing cylinder with an interference fit.

The same procedure is followed in order to permit removal of the sheath from the printing cylinder. Specifically, the hollow interior of the mandrel is again pressurized with compressed air, this in turn resulting in a flow of air through the ports 14 and 16, and in radial expansion of the sheath 42, thus permitting it to be withdrawn from the printing cylinder 10.

In this manner, only a single printing cylinder 10 is required to support any one of a plurality of sheaths 42. Furtyher, it is not necessary to remove the printing cylinder 10 from the mandrel 20 in order to permit removal of a sheath and the substitution of another sheath, thus minimizing down-time of the printing cylinder and eliminating time and labor in the removal of the printing cylinder from the mandrel and its subsequent repositioning thereon.

As will readily be appreciated, various modifications may be made in the specific structure of the illustrated preferred embodiment without departing from the scope of the appended claims.

I claim:

1. A mandrel for use in conjunction with a printing cylinder adapted to receive a resilient sheath on the external surface thereof on which printing plates are mounted, the printing cylinder being perforated to permit the passage therethrough of compressed air for the purpose of expanding the sheath out of frictional contact with the cylinder, said mandrel comprising:

a hollow cylindrical shell having radial perforations extending through the wall thereof;

a trunnion and an expansion head assembly supported by said hollow cylindrical shell at each axial end of said hollow cylindrical shell each expansion head having a gallery closed by a radially outwardly expandable diaphragm; and, at least one hydraulic pump connected to the gallery of each said expansion head for the supply of hydraulic fluid under pressure to said galleries to expand said radially expandable diaphragms radially outwardly;

one of said trunnions having a compressed air supply passage extending therethrough and communicating the interior of said hollow cylindrical shell with a connector for a compressed air supply hose.

2. The mandrel of claim 1, including a single hydraulic pump located in one of said trunnions, passages connecting said pump directly to the gallery of the associated expansion head, and a conduit connecting said pump to the gallery of the other expansion head, whereby said pump is operative to actuate both of said expansion heads simultaneously.

3. The mandrel of claim 1, in which said compressed air supply passage extends axially through said trunnion.

4. The mandrel of claim 1, in which said compressed air supply passage extends axially through said trunnion, and is provided with a branch passage extending laterally of said axial passage and communicating with a connector for a compressed air supply hose.

* * * * *